US007708115B2

(12) United States Patent
Shaya

(10) Patent No.: US 7,708,115 B2
(45) Date of Patent: May 4, 2010

(54) SOUND-ATTENUATING MUFFLER HAVING REDUCED BACK PRESSURE

(76) Inventor: Zvi Shaya, 40 Huzot Ha Yozer Street, Ashkelon (IL) 78785

( * ) Notice: Subject to any disclaimer, the term of this patent is extended or adjusted under 35 U.S.C. 154(b) by 0 days.

(21) Appl. No.: 12/245,870

(22) Filed: Oct. 6, 2008

(65) Prior Publication Data

US 2010/0084220 A1 Apr. 8, 2010

(51) Int. Cl.
*F01N 1/08* (2006.01)
*F01N 1/02* (2006.01)

(52) U.S. Cl. ..... 181/269; 181/272

(58) Field of Classification Search ..... 181/269, 181/272, 282, 249, 255, 257, 264
See application file for complete search history.

(56) References Cited

U.S. PATENT DOCUMENTS

| | | | | | |
|---|---|---|---|---|---|
| 992,839 | A * | 5/1911 | Wolle et al. | 181/264 |
| 2,205,899 | A * | 6/1940 | Chipley | 181/269 |
| 2,239,549 | A * | 4/1941 | Chipley | 181/269 |
| 2,732,026 | A * | 1/1956 | Folts | 181/243 |
| 2,881,852 | A * | 4/1959 | Morrish et al. | 181/275 |
| 3,168,162 | A * | 2/1965 | Clary et al. | 181/246 |
| 3,964,570 | A * | 6/1976 | Morrow | 181/268 |
| 3,989,121 | A * | 11/1976 | Bergson et al. | 181/272 |
| 4,108,276 | A * | 8/1978 | Hall et al. | 181/256 |
| 4,116,303 | A * | 9/1978 | Trudell | 181/252 |
| 4,143,739 | A * | 3/1979 | Nordlie | 181/265 |
| 4,286,689 | A * | 9/1981 | Malmsten | 181/232 |
| 4,574,914 | A * | 3/1986 | Flugger | 181/268 |
| 4,601,363 | A * | 7/1986 | Harris et al. | 181/280 |
| 4,809,812 | A * | 3/1989 | Flugger | 181/268 |
| 4,846,302 | A * | 7/1989 | Hetherington | 181/243 |
| 5,123,502 | A * | 6/1992 | Flugger | 181/264 |
| 5,266,755 | A * | 11/1993 | Chien | 181/252 |
| 5,321,215 | A * | 6/1994 | Kicinski | 181/211 |
| 5,444,197 | A * | 8/1995 | Flugger | 181/264 |
| 5,708,238 | A * | 1/1998 | Asao et al. | 181/272 |
| 5,773,770 | A * | 6/1998 | Jones | 181/268 |
| 6,089,347 | A * | 7/2000 | Flugger | 181/264 |
| 6,116,376 | A * | 9/2000 | Chu | 181/256 |
| 6,158,546 | A * | 12/2000 | Hanson et al. | 181/255 |
| 6,286,623 | B1 | 9/2001 | Shaya | |
| 6,776,257 | B1 | 8/2004 | Shaya | |
| 7,219,764 | B1 * | 5/2007 | Forbes | 181/270 |
| 2006/0054384 | A1 * | 3/2006 | Chen | 181/272 |

OTHER PUBLICATIONS

U.S. Appl. No. 12/170,443, filed Jul. 2008, Shaya.

* cited by examiner

*Primary Examiner*—Edgardo San Martin
(74) *Attorney, Agent, or Firm*—Mark M. Friedman

(57) ABSTRACT

A muffler for an internal combustion engine having a housing with an inlet end with an inlet opening formed for a flow of exhaust gases into the housing and an outlet end with an outlet opening formed for a discharge of exhaust gases from the housing; at least a first chamber, a intermediate and a last chamber sequentially arranged within the housing, the intermediate chamber containing a deflection element; a pipe passing longitudinally through the first chamber so as to open at its downstream end into the intermediate chamber, thereby directing the exhaust gases toward the deflection element; and a perforated pipe extending through the last chamber, the perforated pipe having an upstream opening into the intermediate chamber and configured to channel the exhaust gas to the outlet opening. A sound-attenuating material is deployed in at least one of the first chamber, the intermediate chamber and the last chamber.

9 Claims, 2 Drawing Sheets

SOUND-ATTENUATING MUFFLER HAVING REDUCED BACK PRESSURE

FIELD AND BACKGROUND OF THE INVENTION

The present invention relates to sound-attenuating mufflers for internal combustion engines and, more particularly, to sound-attenuating mufflers generating reduced back pressure.

Numerous muffler constructions have been proposed for the attenuation of the sound component of an exhaust gas stream from an internal combustion engine. The present invention belongs to the group of low back-pressure sound-attenuating mufflers described in U.S. Pat. Nos. 6,286,623 and 6,776,257 and U.S. patent application Ser. No. 12/170,443 to the present inventor and incorporated herein by reference.

The low back-pressure sound-attenuating mufflers of U.S. Pat. Nos. 6,286,623 and 6,776,257 are well suited for sports cars.

There is therefore a need for a low back-pressure sound-attenuating muffler having a lower decibel output than the previous mufflers so as to be usable on regular passenger vehicles.

SUMMARY OF THE INVENTION

The present invention is a low back-pressure sound-attenuating muffler having a lower decibel output than the previous mufflers so as to be usable on regular passenger vehicles.

According to the teachings of the present invention there is provided, a muffler for an internal combustion engine comprising: (a) a housing having an inlet end with an inlet opening formed for a flow of exhaust gases into the housing and an outlet end with an outlet opening formed for a discharge of exhaust gases from the housing; (b) at least a first chamber, an intermediate and a last chamber sequentially arranged within the housing, the intermediate chamber containing a deflection element chosen from a group including: (i) a hollow pyramid; and (ii) a dome-shaped partition; (c) a pipe passing longitudinally through the first chamber so as to open at its downstream end into the intermediate chamber, thereby directing the exhaust gases toward the deflection element; and (d) a perforated pipe extending through the last chamber, the perforated pipe having an upstream opening into the intermediate chamber and configured to channel the exhaust gas to the outlet opening.

According to a further teaching of the present invention, the pipe passes longitudinally through an axially central region of the first chamber.

According to a further teaching of the present invention, a partition separating the first and the intermediate chambers includes a hole that enables some of the exhaust gases to pass freely between the first chamber and the intermediate chamber.

According to a further teaching of the present invention, the first chamber extends between 10%-85% of the total length of the housing.

According to a further teaching of the present invention, the last chamber extends between 5%-80% of the total length of the housing.

According to a further teaching of the present invention, there is also provided a sound-attenuating material deployed in at least one of the first chamber, the intermediate chamber and the last chamber.

According to a further teaching of the present invention, the sound-attenuating material is configured from at least one chosen from the group that includes mineral fibers and synthetic fibers.

According to a further teaching of the present invention, the hollow pyramid deflection element has interior surfaces and exterior surfaces joining at a first end to form a pyramidal apex, the pyramidal apex pointing toward the inlet end of the muffler and extending at a second end to form an open base interconnected to a partition separating the intermediate and the last cambers.

According to a further teaching of the present invention, the dome-shaped partition deflection element has an exterior surface, a first end of the exterior surface pointing toward the inlet end of the muffler, and widening out at a second end to form an open base interconnected to a partition separating the intermediate and the third cambers.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
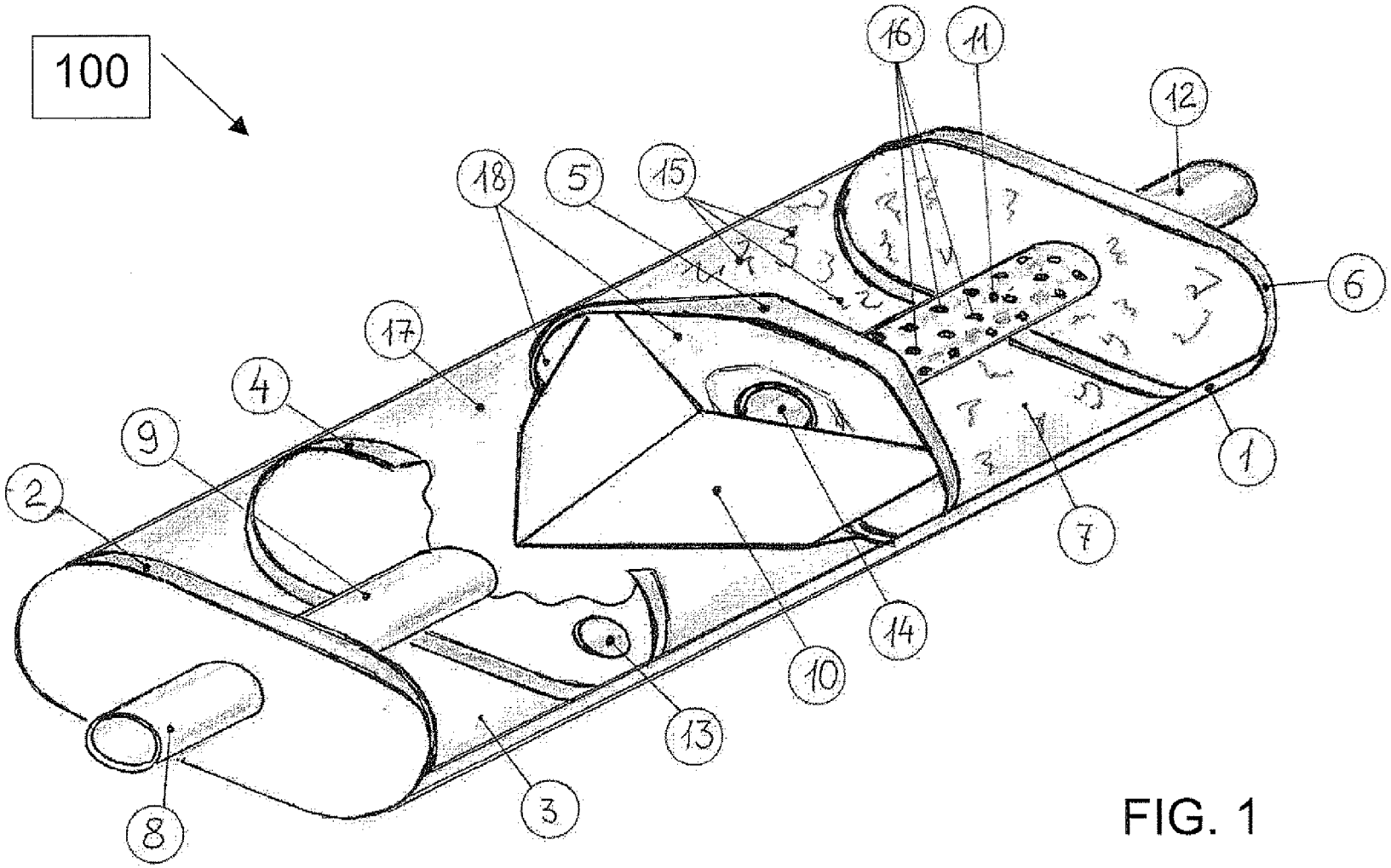
FIG. 1 is a perspective, cut open view of a first preferred embodiment of a muffler constructed and operational according to the teachings of the present invention having a pyramidal deflection element.

The present invention is a low back-pressure sound-attenuating muffler having a lower decibel output than the previous mufflers so as to be usable on regular passenger vehicles.

The principles and operation of low back-pressure sound-attenuating muffler according to the present invention may be better understood with reference to the drawings and the accompanying description.

By way of introduction, described below are two exemplary embodiments of the present invention. The embodiment of FIG. 1 relates to a muffler combining the features of the present invention with the pyramidal partition deflection element of U.S. Pat. No. 6,286,623. The embodiment of FIG. 2 relates to a muffler combining the features of the present invention with the dome-shaped deflection element of U.S. Pat. No. 6,776,257, both to the present inventor and incorporated herein in their entirety.

It should be noted that as used herein, references to sequence such as first, intermediate and last refer to the relationship of elements in the drawings and are not intended to limit the scope of the present invention.

Referring now to the drawings, FIG. 1 illustrates a first preferred embodiment 100 of the muffler of the present invention generally defined by a housing 1 and end walls 2 and 6. An inlet 8 for introducing exhaust gases into the muffler 100 is provided in end wall 2. The inlet configuration of the mufflers of the present invention includes an inlet pipe 9 that is axially centered within the housing 1 and extends from the inlet 8 through the first chamber 3 and opens at its downstream end into the intermediate chamber 17 sequentially arranged within muffler 100.

As the flow of exhaust gases leaves the downstream end of pipe 9 and enters the intermediate chamber 17, the flow of exhaust gases encounters the apex of pyramidal deflection element 10 causing the flow to be deflected along the exterior faces of pyramidal deflection element 10 and towards the interior surface of the outer wall of housing 1. It will be appreciated that although pipe 9 and the apex of pyramidal deflection element 10 are illustrated herein as substantially axially centered within the housing 1, it is within the scope of the present invention to provide a non-straight pipe that extends from an inlet that is not axially centered within the housing 1 to a downstream end that is aligned with the apex of pyramidal deflection element 10, which need not be axially centered within the housing 1.

Opening 13 configured in interior partition wall 4 allows exhaust gasses to enter the first chamber 3 and thereby alleviate some excess pressure that may from in the intermediate chamber 17. It will be appreciated that interior partition wall 4 may be configured with a single opening 13 as illustrated herein, or with a plurality of opening to allow passage of exhaust gasses between the first 3 and intermediate 17 chambers.

The exhaust gases then flow through the four spaces 18 formed at the base of the pyramidal deflection element 10. A substantial first portion of the exhaust gases continue to flow in the direction of the opening 14 to the perforated pipe 11, thereby creating a low pressure region inside the pyramidal deflection element 10. Consequently, a second portion of the exhaust gases changes direction and enters (is drawn into) the inside region of pyramidal deflection element 10 before continuing toward opening 14. The flow pattern thus created serves to decrease the sounds associated with the exhaust.

Perforated pipe 11 extends from opening 14 through the last chamber 7 to the outlet pipe 12. As the exhaust gases flow through perforated pipe 11, the associated sound waves pass freely through the perforations 16 into the last chamber 7 and are thereby further dissipated. Preferably, as illustrated herein, the last chamber 7 contains a sound-attenuating material made from mineral fibers or synthetic fibers either individually or in combination. Such fibers include, but are not limited to, Asbestos fibers, basalt fibers, mineral wool, glass wool, metal wools such as steel wool and bronze wool, carbon fiber and aramid fiber such as Kevlar®.

Figure 2:
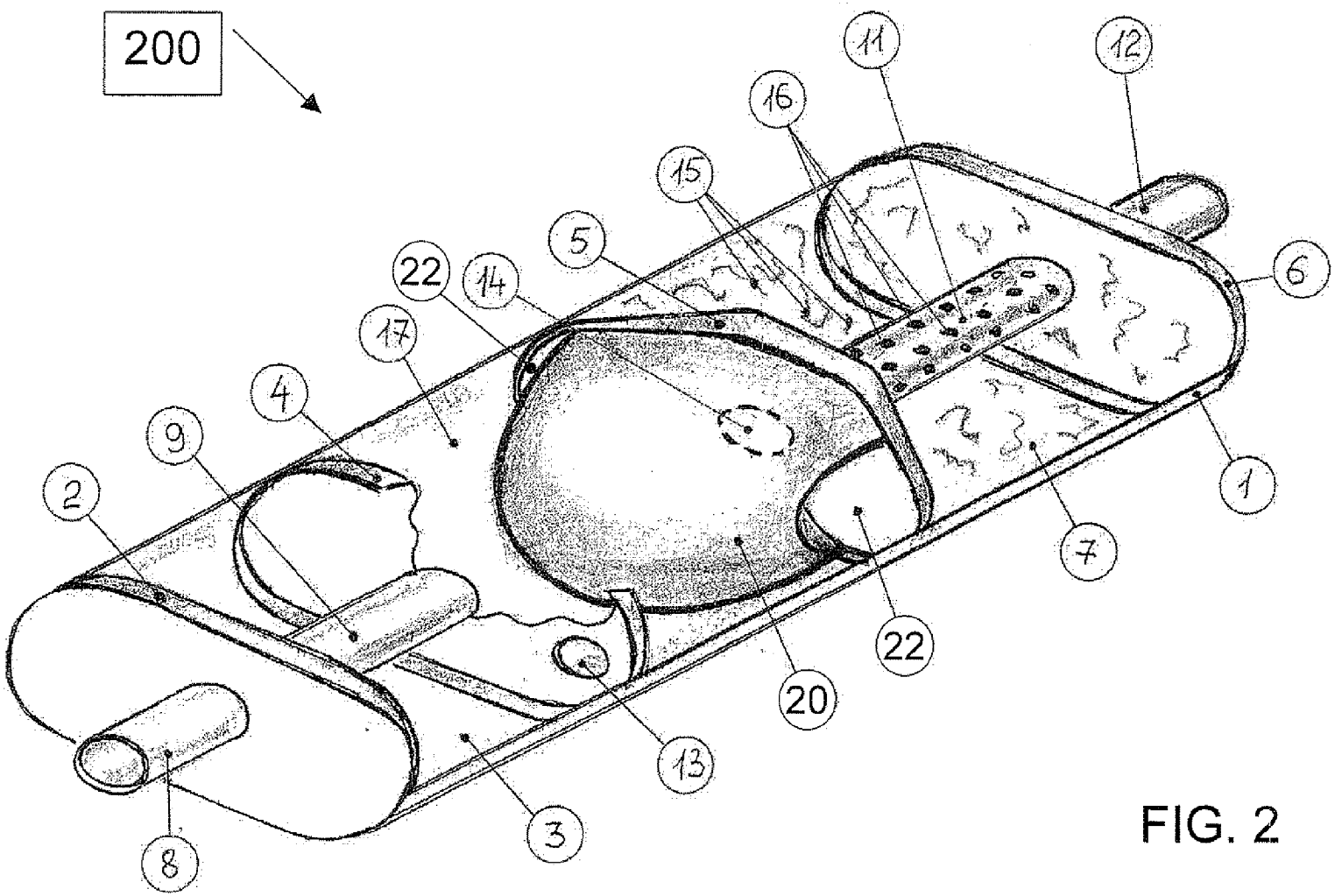
FIG. 2 is a perspective, cut-open view of a second preferred embodiment of a muffler constructed and operational according to the teachings of the present invention having a dome-shaped deflection element.

FIG. 2 illustrates a second preferred embodiment 200 of the muffler of the present invention. Therefore, equivalent elements are similarly numbered. Muffler 200 is also generally defined by a housing 1 and end walls 2 and 6. An inlet 8 for introducing exhaust gases into the muffler 100 is provided in end wall 2. The inlet configuration of the mufflers of the present invention includes an inlet pipe 9 that is axially centered within the housing 1 and extends from the inlet 8 through the first chamber 3 and opens at its downstream end into the intermediate chamber 17 sequentially arranged within muffler 100.

As the flow of exhaust gases leaves the downstream end of pipe 9 and enters the intermediate chamber 17, the flow of exhaust gases encounters the top of the dome-shaped deflection element 20, causing the flow of exhaust gases to be deflected along the exterior face of dome-shaped deflection element 20. Dome-shaped deflection element 20 has an exterior surface, a first end of the exterior surface points toward the inlet end of the muffler and widens out at a second end to form a base. The dome-shaped deflection element also has at least two partition openings 22 disposed between the first end and the second end preferably formed at the base end. The exhaust gases flow through openings 22 in the sides of dome-shaped deflection element 20. Openings 22 are preferably disposed on opposite sides of dome-shaped deflection element 20.

It will be appreciated that although pipe 9 and the dome-shaped deflection element 20 are illustrated herein as substantially axially centered within the housing 1, here too, it is within the scope of the present invention to provide a non-straight pipe that extends from an inlet the is not axially centered within the housing 1 to a downstream end that is aligned with the apex of dome-shaped deflection element 20, which need not be axially centered within the housing 1.

As discussed above, here too, opening 13 configured in interior partition wall 4 allows exhaust gasses to enter the first chamber 3 and thereby alleviate some excess pressure that may from in the intermediate chamber 17. It will be appreciated that in this embodiment as well, interior partition wall 4 may be configured with a single opening 13 as illustrated herein, or with a plurality of opening to allow passage of exhaust gasses between the first 3 and intermediate 17 chambers.

As the exhaust gases flow through the openings 22 formed at the base of the dome-shaped deflection element 20, a substantial first portion of the exhaust gases continue to flow in the direction of the opening 14 to the perforated pipe 11, thereby creating a low pressure region inside the dome-shaped deflection element 10. Consequently, a second portion of the exhaust gases changes direction and enters (is drawn into) the inside region of dome-shaped deflection element 10 before continuing toward opening 14. Here too, the flow pattern thus created serves to decrease the sounds associated with the exhaust.

Perforated pipe 11 extends from opening 14 through the last chamber 7 to the outlet pipe 12. As the exhaust gases flow through perforated pipe 11, the associated sound waves pass freely through the perforations 16 into the last chamber 7 and are thereby further dissipated. Preferably, as illustrated herein, the last chamber 7 contains a sound-attenuating material made from mineral fibers or synthetic fibers either individually or in combination, as mentioned above.

With this basic understanding of the general structure of the preferred embodiments 100 and 200 of the muffler of the present invention, it will be appreciated that inlet 8 is configured for attachment to the exhaust pipe of the vehicle on which the muffler is deployed and therefore may vary in diameter depending on the specifications of the of the vehicle manufacturer. It will be appreciated that inlet 8 may be configured as two or more inlet pipes 9 that come together and have a single downstream end that is aligned with the apex of the deflection element. Similarly, the outlet pipe 12 may be configured as more than one outlet pipe.

It should be noted that the first chamber 3 may extend for a distance of 10%-85% of the total length of the muffler 100. Further, the first chamber may be configured as more than one chamber.

Similarly, the last chamber 7 may extend for a distance of 5%-80% of the total length of the muffler 100, and the last chamber may be configured as more than one chamber.

Further, although the sound-attenuating material 15 is illustrated herein as being deployed in the last chamber 7, it will be appreciated that sound deadening material may be deployed in any of the first 3, intermediate 17 and last 7 chambers either individually or in combination. Also, the sound-attenuating material may deployed so as to partially fill or fully fill the chamber in which it is deployed.

It will be appreciated that the above descriptions are intended only to serve as examples and that many other embodiments are possible within the spirit and the scope of the present invention.

What is claimed is:

1. A muffler for an internal combustion engine comprising:

(a) a housing having an inlet end with an inlet opening formed for a flow of exhaust gases into said housing and an outlet end with an outlet opening formed for a discharge of exhaust gases from said housing;

(b) at least a first chamber, an intermediate and a last chamber sequentially arranged within said housing, said intermediate chamber containing a deflection element chosen from a group including:

(i) a hollow pyramid; and (ii) a dome-shaped partition;

(c) a non-perforated pipe passing longitudinally from said inlet opening through said first chamber so as to open only at its downstream end solely into said intermediate chamber, thereby directing said exhaust gases toward said deflection element; and (d) a perforated pipe extending through said last chamber, said perforated pipe having an upstream opening into said intermediate chamber and configured to channel said exhaust gas to said outlet opening.

2. The muffler of claim 1, wherein said pipe passes longitudinally through an axially central region of said first chamber.

3. The muffler of claim 1, wherein a partition separating said first and said intermediate chambers includes a hole that enables some of said exhaust gases to pass freely between said first chamber and said intermediate chamber.

4. The muffler of claim 1, wherein said first chamber extends between 10%-85% of the total length of said housing.

5. The muffler of claim 1, wherein said last chamber extends between 5%-80% of the total length of said housing.

6. The muffler of claim 1, further including a sound-attenuating material deployed in at least one of said first chamber, said intermediate chamber and said last chamber.

7. The muffler of claim 6, wherein said sound-attenuating material is configured from at least one chosen from the group that includes, mineral fibers and synthetic fibers.

8. The muffler of claim 1, wherein said hollow pyramid deflection element has interior surfaces and exterior surfaces joining at a first end to form a pyramidal apex, said pyramidal apex pointing toward said inlet end of the muffler and extending at a second end to form an open base interconnected to a partition separating said intermediate and said last cambers.

9. The muffler of claim 1, wherein said dome-shaped partition deflection element has an exterior surface, a first end of said exterior surface pointing toward said inlet end of the muffler, and widening out at a second end to form an open base interconnected to a partition separating said intermediate and said third cambers.

* * * * *